US011787223B2

(12) United States Patent
Folgoas

(10) Patent No.: US 11,787,223 B2
(45) Date of Patent: Oct. 17, 2023

(54) MULTIFUNCTION WRITING INSTRUMENT

(71) Applicant: SOCIETE BIC, Clichy (FR)

(72) Inventor: Loic Folgoas, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 106 days.

(21) Appl. No.: 17/600,237

(22) PCT Filed: Apr. 10, 2020

(86) PCT No.: PCT/EP2020/060306
§ 371 (c)(1),
(2) Date: Sep. 30, 2021

(87) PCT Pub. No.: WO2020/212277
PCT Pub. Date: Oct. 22, 2020

(65) Prior Publication Data

US 2022/0219483 A1 Jul. 14, 2022

(30) Foreign Application Priority Data

Apr. 16, 2019 (EP) ..... 19305494

(51) Int. Cl.
*B43K 27/12* (2006.01)
*B43K 29/08* (2006.01)

(52) U.S. Cl.
CPC ..... *B43K 27/12* (2013.01); *B43K 29/08* (2013.01)

(58) Field of Classification Search
CPC ..... B43K 27/08; B43K 27/12; B43K 29/08; G06F 3/03545
See application file for complete search history.

(56) References Cited

U.S. PATENT DOCUMENTS 7,785,027 B1 * 8/2010 McKinley ..... B43K 29/08 401/32
9,061,541 B2 6/2015 Elmore
(Continued)

FOREIGN PATENT DOCUMENTS

CN 201965567 U 9/2011
CN 102405454 A 4/2012
(Continued)

OTHER PUBLICATIONS

International Search Report and Written Opinion in International Application No. PCT/EP2020/060306, dated Jun. 9, 2020 (14 pages).
(Continued)

*Primary Examiner* — David P Angwin
*Assistant Examiner* — Bradley S Oliver
(74) *Attorney, Agent, or Firm* — Bookoff McAndrews, PLLC

(57) ABSTRACT

A multifunction writing instrument comprising a body extending along an axial direction and receiving at least two retractable writing elements, each retractable writing element comprising a writing tip, a reservoir and a button, each retractable writing element being movable between a writing position in which the writing tip extends from the body and a retracted position in which the writing tip is retracted within the body, each retractable writing element being connected to an electronic unit in order to detect which retractable writing element is in the writing position.

16 Claims, 3 Drawing Sheets

(56) References Cited

U.S. PATENT DOCUMENTS

| | | | | |
|---|---|---|---|---|
| 9,529,455 | B2 * | 12/2016 | Hautson | G06F 3/0418 |
| 2003/0063943 | A1 | 4/2003 | Lapstun et al. | |
| 2005/0231488 | A1 | 10/2005 | Chou | |
| 2006/0222437 | A1 | 10/2006 | Yamauchi et al. | |
| 2010/0061793 | A1 | 3/2010 | Bender et al. | |
| 2017/0322643 | A1 * | 11/2017 | Eguchi | G06F 3/04162 |
| 2017/0357340 | A1 | 12/2017 | Kamiyama et al. | |

FOREIGN PATENT DOCUMENTS

| | | | |
|---|---|---|---|
| CN | 107430449 | A | 12/2017 |
| CN | 109551937 | A | 4/2019 |
| WO | 2009091596 | A1 | 7/2009 |
| WO | 2016153505 | A1 | 9/2016 |

OTHER PUBLICATIONS

Extended European Search Report in European Patent Application No. 19305494.7, dated Oct. 17, 2019 (7 pages).
First Office Action issued in corresponding Chinese Application No. 202080019681X dated Nov. 9, 2022 (10 pages).
First Search issued in corresponding Chinese Application No. 202080019681X dated Nov. 1, 2022 (2 pages).

* cited by examiner

MULTIFUNCTION WRITING INSTRUMENT

CROSS REFERENCE TO RELATED APPLICATION(S)

This application is a National Stage Application of International Application No. PCT/EP2020/060306, filed on Apr. 10, 2020, now published as WO2020212277 and which claims benefit from European patent application EP19305494.7 filed on 16 Apr. 2019, the entire contents of which being incorporated herein by reference.

TECHNICAL FIELD

The present disclosure relates to a multifunction writing instrument. A multifunction writing instrument is a writing instrument comprising a plurality of writing elements, each writing element being selectively usable.

BACKGROUND

Traditional writing instruments (i.e. writing instruments having ink/lead) may be used with digital slates in order to digitalize writing/drawing. However, when a multifunction writing instrument is used, it is not possible to detect whether the user changes the writing element used, for example different color inks. Such a change cannot be taken into account during digitalization. Therefore a need exists to improve the digitalization of multifunction writing instrument use.

SUMMARY

An embodiment relates to a multifunction writing instrument comprising a body extending along an axial direction and receiving at least two retractable writing elements, each retractable writing element comprising a writing tip, a reservoir and a button, each retractable writing element being movable between a writing position in which the writing tip extends from the body and a retracted position in which the writing tip is retracted within the body, and an electronic unit configured to detect which retractable writing element is in the writing position.

In the following and unless otherwise indicated, "writing instrument" is used for "multifunction writing instrument" and "writing element" is used for "retractable writing element".

The axial direction corresponds to the axis of the body. In the present disclosure, a retractable writing element is formed by any retractable set comprising a writing point or tip, a reservoir and a button. The writing point may be a felt tip, a ballpoint tip, a mechanical pencil, a graphite pencil lead, chalk, or any other means making it possible to write on a substrate. The reservoir may be provided with ink or with one or several leads. The writing elements may be retractable by any mechanism known by the skilled person. The button of each writing element permits the actuation of the writing element in order to move the writing element from the retracted position to the writing position. The button may be used in order to move the writing element from the writing position to the retracted position. For example, a writing element in the writing element may automatically move to its retracted position when another writing element is moved from its retracted position to its writing position. Only one writing element may be in the writing position at a time.

The electronic unit may be active or passive (i.e. provided with an electric power unit such as a battery or not). The writing instrument may comprise a single electronic unit. The electronic unit may comprise several independent sub-units and a shared common main unit. The electronic unit is configured to detect which retractable writing element is in the writing position. Thus, the electronic unit may be used in order to automatically indicate to a digital slate which writing element is used and improve the friendliness of the writing instrument.

In some embodiments, the electronic unit may comprise the same number of switches as retractable writing elements, each retractable writing element being associated (or configured to interact) with a switch.

Each retractable writing element may be associated with a single switch. By associating each writing element to a switch, the movement of the writing element from its retracted position to its writing position may be reliably detected and thus improves the ease of use of the writing instrument.

In some embodiments, the electronic unit may comprise the same number of chips as retractable writing elements, each retractable writing element comprising one of the chips.

The button of each retractable writing element may comprise a chip. By providing a chip to each writing element, the movement of the writing element from its retracted position to its writing position may be reliably detected and thus improves the ease of use of the writing instrument.

In some embodiments, the electronic unit may comprise a wireless communication system configured to communicate with an outer device.

For example, the wireless communication system may be a Near Field Communication (NFC) system, a Bluetooth system, a Wi-Fi system, a Radio Frequency Identification (RFID) system, etc. Such a system allows automatic communication between the writing instrument and a digital slate and thus improves the ease of use.

In some embodiments, the chip of a retractable writing element may be electrically connected to the wireless communication system when the retractable writing element is in the writing position while the chip of a retractable writing element is electrically disconnected from wireless communication system when the retractable writing element is in the retracted position.

Such a configuration is cost effective, reliable and permits to save space within the writing instrument. For example, the wireless communication system may comprise some electrical contacts, for example two electrical contacts, while each retractable writing element comprises complementary electrical contacts. When a retractable writing element is in the writing position, the complementary contacts may be electrically connected with the respective contacts of the wireless communication system. Thus, in this position, the chip may be connected with the wireless communication system. When the retractable writing element is in the retracted position the complementary contacts may be electrically disconnected from the respective contacts of the wireless communication system. Thus, in this position, the chip may be disconnected from the wireless communication system. When a retractable writing element is in the writing position, a closed electrical circuit may be formed while an open electrical circuit is formed when the retractable writing element is in the retracted position. For example, the chip are different, each chip having a unique ID, and forms a unique passive RFID tag when the writing element is in the writing position.

In some embodiments, the multifunction writing instrument may comprise a rear part accommodating the buttons and a front part accommodating the writing tips, wherein the wireless communication system comprises an antenna placed within the front part.

For example the writing instrument may comprise a front barrel as a front part and a rear barrel as a rear barrel. Placing the antenna in the front part provides a space for the retraction mechanism in the rear part of the writing elements. Placing the antenna in the front part improves the wireless communication quality, the antenna being closer to an associated outer receiver, e.g. a receiver included within a digital slate.

In some embodiments, the multifunction writing instrument may comprise a device configured to be detected by a space detection system.

Some digital slates need a dedicated device to be provided to the writing instrument in order to digitalize the writing/drawing. The device may by unitary or integrated with the rest of the writing instrument, or may form a distinct element which is mountable onto the writing instrument. Such a device improves the ease of use.

In some embodiments, the device may be a magnet ring.

For example, the magnetic ring may be integrated within the front part of the writing instrument. Such a device is cost effective and reliable.

An embodiment relates to a set comprising a digital slate comprising a space detection system configured to detect the space position of a writing instrument and a multifunction writing instrument according to any one of the embodiments of the present disclosure.

In some embodiments, the digital slate may comprise a system for identifying which retractable writing element of the multifunction writing instrument is in the writing position.

BRIEF DESCRIPTION OF THE DRAWINGS

The disclosure can be better understood by reading the detailed description of various embodiments given as non-limiting examples. The description refers to the accompanying sheets of figures, in which.

DETAILED DESCRIPTION

Figure 1:
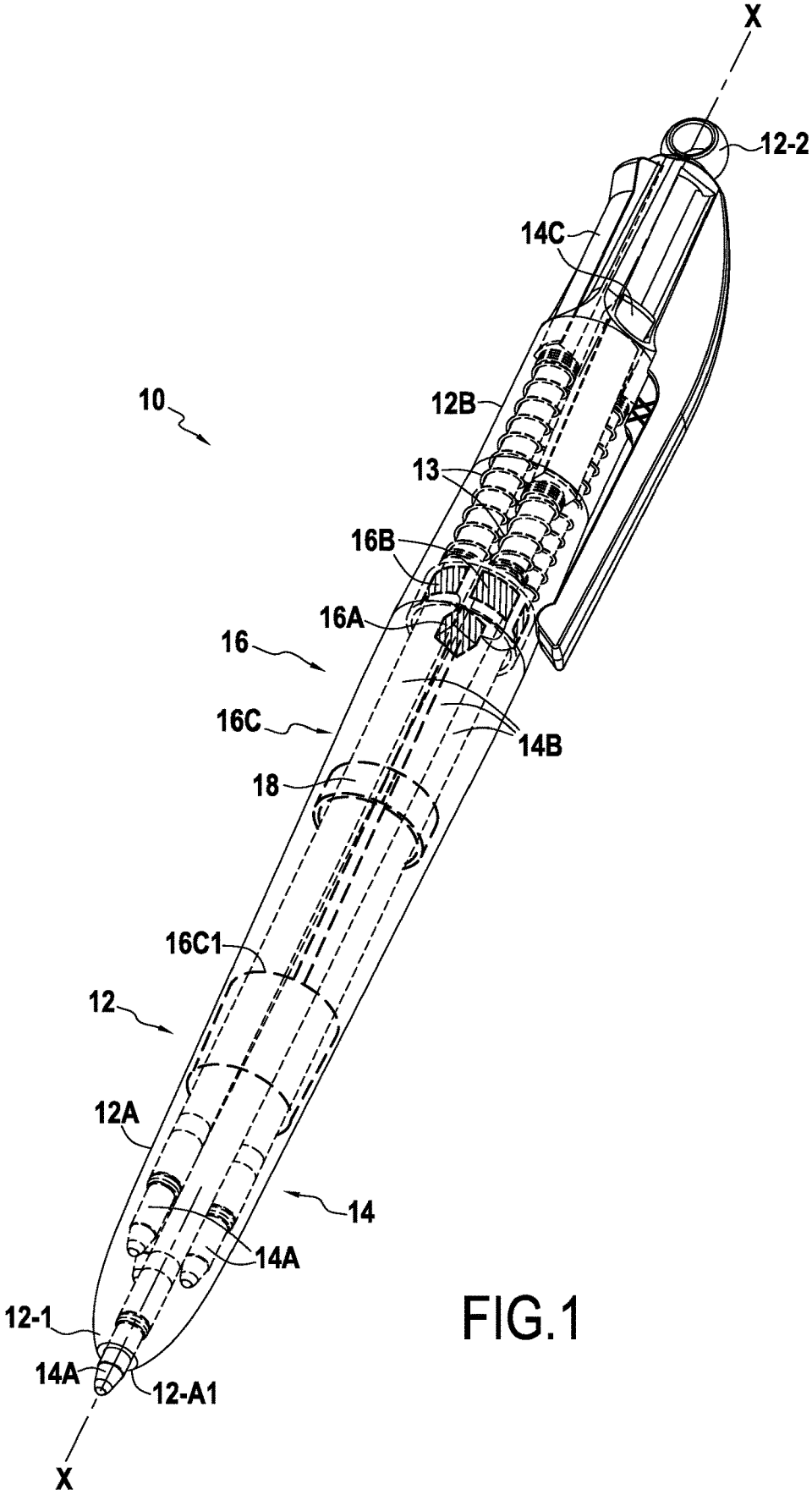
FIG. 1 shows a multifunction writing instrument according to a first embodiment.

FIG. 1 shows a multifunction writing instrument 10 according to a first embodiment. The multifunction writing instrument 10 comprises a body 12 receiving a plurality of retractable writing elements 14, in this example four writing elements 14 is used however any appropriate number of writing elements may be used. It is noted that the inner elements of the writing instruments are shown in FIG. 1 by transparency, however the body may not be transparent.

The body 12 extends along an axial direction X and may comprise a front barrel 12A as a front part and a rear barrel 12B as a rear part. The body 12 presents a first end 12-1, or front end, and a second end 12-2, or rear end, opposite to the first end 12-1 along the axial direction X. In this example, the front barrel 12A has the first end 12-1 while the rear barrel 12B has the second end 12-2. The first end 12-1 is provided with a through hole 12-A1 for the passage of the writing point 14A of the writing elements 14.

Each retractable writing element 14 comprises a writing point 14A, a reservoir 14B and a button 14C. In this example, the writing points 14A may be ball points while the reservoir 14B may be filed with ink. The inks of the different reservoirs 14B may be of different colours. In other words, each of the writing elements 14 may be configured to write with a different colour. The buttons 14C are disposed within the rear barrel 12B while the front barrel 12A accommodates the writing tips 14A (in their retracted position). The reservoirs 14B extend between the button 14B and the writing tips 14A, and are accommodated in both the front barrel 12A and the rear barrel 12B.

The writing elements 14 are movable between a writing position in which the writing tip 14A extends from the body 12 and a retracted position in which the writing tip 14A is retracted within the body 12. In FIG. 1, one writing element 14 is in the writing position while all the other writing elements 14 are in the retracted position. The retraction mechanism of each writing element 14 is well known by the skilled person and is not described in detail. It is noted that the retraction mechanism may comprise a compression spring 13.

The writing instrument 10 is provided with a single electronic unit 16. In this example, the electronic unit 16 may comprise an integrated circuit 16A, four switches 16B and a wireless communication system 16C, in this example a Near Field Communication (NFC) system, which comprises an antenna 16C1.

The electronic unit 16 is configured to detect which retractable writing element 14 is in the writing position. In this example, the electronic unit 16 comprises as many switches 16B as writing elements 14. In this example, each button 14C may be associated with a switch 16B. Each button 14C may be coupled to a switch 16B, for example via the compression spring 13 of its retraction mechanism. For example, the switch 16B may be a pressure sensitive switch which is turned on when a pressure higher or equal to a predetermined pressure is applied thereto and which is turned off when a pressure lower than the predetermined pressure is applied thereto. The antenna 16C1 is disposed within the front barrel 12A.

The writing instrument 10 is provided with a device 18 configured to be detected by a space detection system. In this example, the device 18 may be a magnet ring. In this example, the magnet ring 18 may be accommodated within the front barrel 12A In this example both the antenna 16C1 and the magnet ring 18 have an annular shape, of axis X. They may be disposed co-axially within the front barrel 12A. The antenna 16C1 is closer to the first end 12-1 than the magnet ring 18.

In this example, when a button 14C of a writing element 14 is actuated in order to place the writing element in the writing position, the button 14C actuates the switch 16B connected thereto. The actuation of the switch is detected by the electronic unit 16, which then sends a signal 30 via the antenna 16C1 to indicate which writing element 14 is in the writing position.

Figure 2:
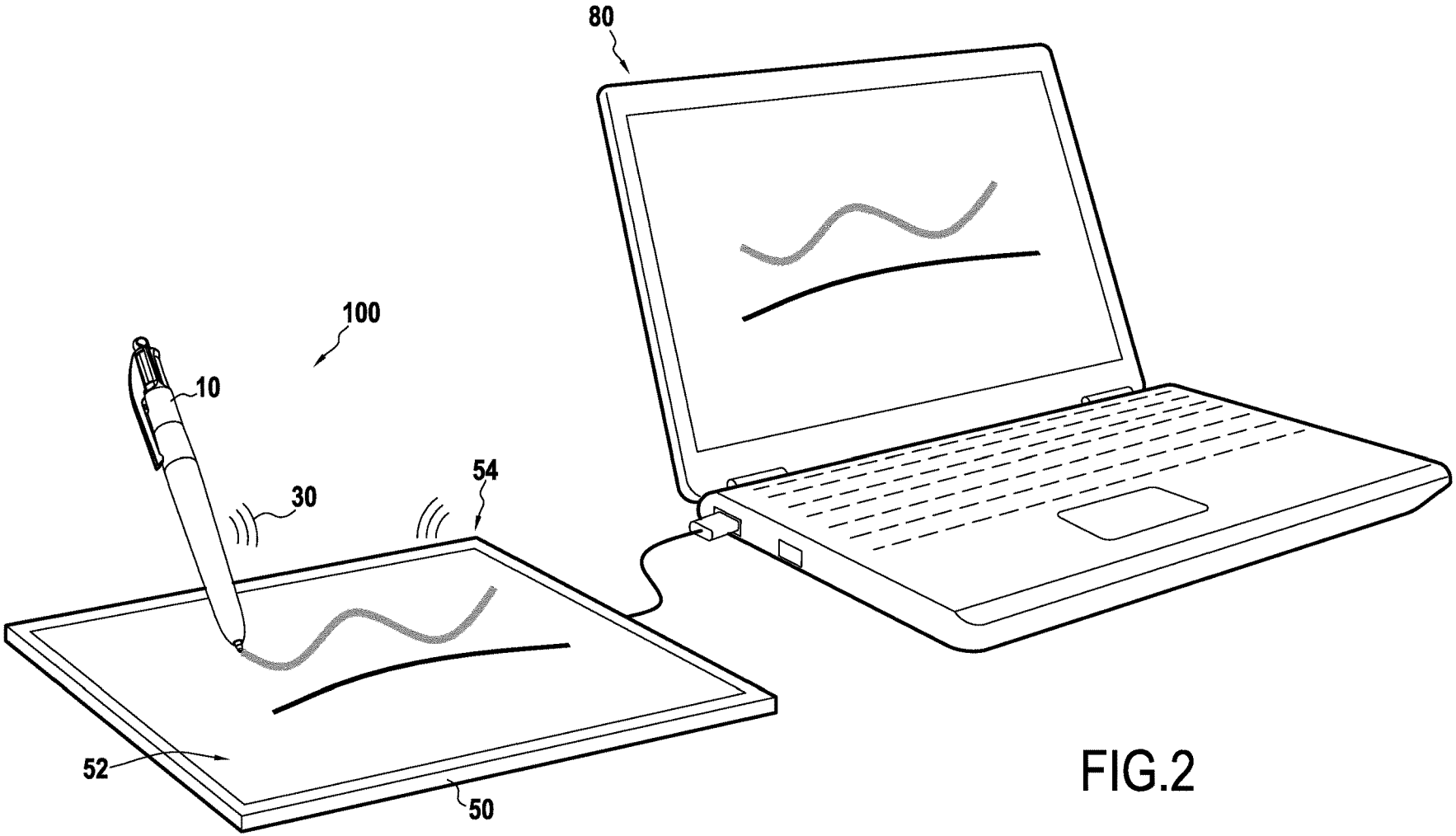
FIG. 2 shows a set comprising a digital slate and the multifunction writing instrument.

For example, in a set 100 shown in FIG. 2 comprising the writing instrument 10 and a digital slate 50, the signal sent via the antenna 16C may be received and processed by a digital slate 50. In this example, the slate 50 may comprise a space detection system 52 which is configured to detect the position of the device 18 and a system 54 for identifying which writing element 14 is in the writing position. Such a space detection system 52 is known by the skilled person and is not described in detail. The system 54 may be a Near Field Communication (NFC) system configured to receive the signal 30 sent by the writing instrument 10. The slate 50 is then able to digitalise the colour of writing/drawing which is written/drawn onto the slate 50 (or onto a sheet of paper placed onto the slate 50), for example, as shown in FIG. 2 wherein the slate 50 is connected to a computer 80 (which is not part of the set 100), the computer 80 displays the writing/drawing with the appropriate colours which has been digitalized by the slate 50.

Figure 3:
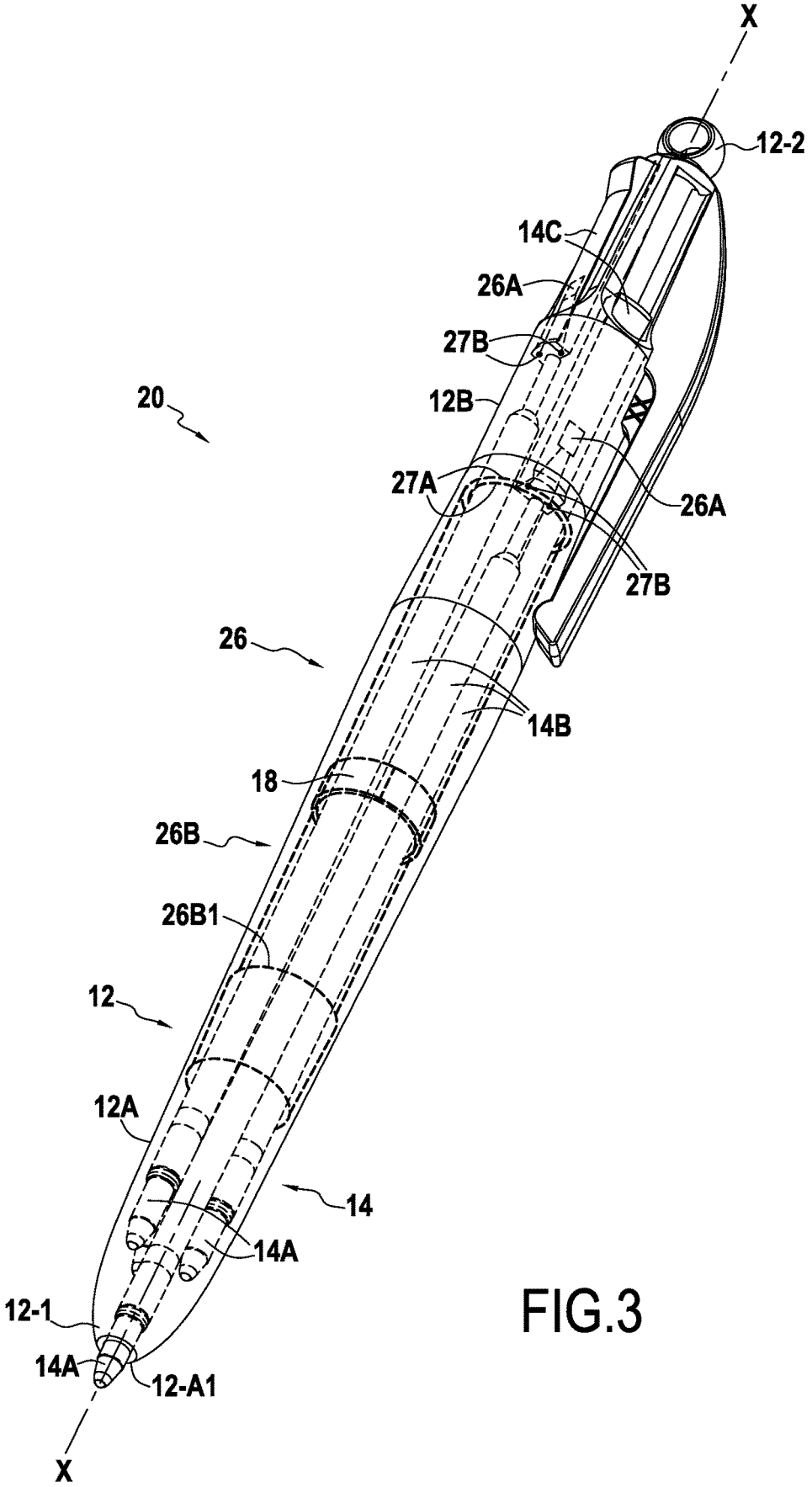
FIG. 3 shows a multifunction writing instrument according to a second embodiment.

FIG. 3 shows a multifunction writing instrument 20 according to a second embodiment. The multifunction writing instrument 20 of the second embodiment is similar to the multifunction writing instrument 10 of the first embodiment, except the electronic unit.

In the example of the second embodiment, the electronic unit 26 may comprise different chips 26A and a wireless communication system 26B, in this example a Radio Frequency Identification (RFID) system, which comprises an antenna 2661. In this example, the electronic unit 26 comprises as many chips 26A as writing elements 14. The chips 26A form independent sub-units while antenna 26B1 forms a shared common main unit.

In this example, each chip 26A is embedded within a button 14C. The antenna 26B1 comprises electrical contacts 27A, in this example two electrical contacts 27A. Complementary electrical contacts 27B, in this example two complementary electrical contacts 27B, are provided at the surface to each button 14C, in order to electrically connect the antenna 26B1 with the chip 26A embedded within a button 14C when the associated writing element 14 is in the writing position. When say writing element 14 is in the retracted position, the complementary contacts 27B are distant from the contact 27A, and the chip 26A is thus electrically disconnected from the antenna 2661. The electrical contacts 27A may have an annular shape. Due to this annular shape, the antenna 26B1 may have only two contacts 27A, these contacts being configured to electrically connect the respective complementary contact 27B of any of the writing elements 14.

The set 100 shown in FIG. 2 may comprise the writing instrument 10 of the first embodiment or the writing instrument 20 of the second embodiment.

Although the present disclosure is described with reference to specific examples, it is to be understood that these examples are merely illustrative of the principles and applications of the present disclosure. In particular, individual characteristics of the various embodiments shown and/or mentioned may be combined in additional embodiments. Consequently, the description and the drawings should be considered in a sense that is illustrative rather than restrictive.

Additionally, all of the disclosed features of an apparatus may be transposed, alone or in combination, to a method and vice versa.

It is intended that the specification and the examples be considered as exemplary only, with a true scope of the invention being indicated by the following claims.

The invention claimed is:

1. A multifunction writing instrument comprising:

a body extending along an axial direction and receiving two or more retractable writing elements, the retractable writing elements comprising a writing tip, the retractable writing elements being movable between a writing position in which the writing tip extends from the body and a retracted position in which the writing tip is retracted within the body, and an electronic unit configured to detect which retractable writing element is in the writing position, wherein the electronic unit comprises a wireless communication system and a total number of chips and switches that is the same as a total number of retractable writing elements; and wherein the chip or the switch of a retractable writing element is electrically connected to the wireless communication system when the retractable writing element is in the writing position, and the chip or the switch of the retractable writing element is electrically disconnected from the wireless communication system when the retractable writing element is in the retracted position.

2. The multifunction writing instrument according to claim 1, wherein the electronic unit comprises the same number of switches as retractable writing elements, each retractable writing element being associated with a switch.

3. The multifunction writing instrument according to claim 1, wherein the electronic unit comprises the same number of chips as retractable writing elements, each retractable writing element comprising one of the chips.

4. The multifunction writing instrument according to claim 1, wherein each retractable writing element comprising either one of the chips or one of the switches.

5. The multifunction writing instrument according to claim 1, wherein the wireless communication system is configured to communicate with an outer device.

6. The multifunction writing instrument according to claim 3, wherein the chip of a retractable writing element is electrically connected to the wireless communication system when the retractable writing element is in the writing position while the chip of a retractable writing element is electrically disconnected from wireless communication system when the retractable writing element is in the retracted position.

7. The multifunction writing instrument according to claim 1, wherein the retractable writing elements further comprise a reservoir, a button, a rear part accommodating the buttons and a front part accommodating the writing tips.

8. The multifunction writing instrument of claim 5, wherein the wireless communication system comprises an antenna placed within a front part.

9. The multifunction writing instrument according to claim 1, comprising a device configured to be detected by a space detection system.

10. The multifunction writing instrument according to claim 9, wherein the device is a magnet ring.

11. A set comprising a digital slate comprising a space detection system configured to detect the space position of a writing instrument and a multifunction writing instrument according to claim 1.

12. The set according to claim 11, wherein the digital slate comprises a system for identifying which retractable writing element of the multifunction writing instrument is in the writing position.

13. A multifunction writing instrument comprising a body extending along an axial direction and receiving two or more retractable writing elements, each of the retractable writing elements comprising a writing tip and a chip, a reservoir and a button, the retractable writing elements being movable between a writing position in which the writing tip extends from the body and a retracted position in which the writing tip is retracted within the body, the multifunction writing instrument further comprising an electronic unit configured to detect which retractable writing element is in the writing position;

wherein each chip of each retractable writing element is electrically connected to a wireless communication system of the electronic unit when the retractable writing element is in the writing position and is electrically disconnected from the wireless communication system when the retractable writing element is in the retracted position.

14. The multifunction writing instrument according to claim 13, further comprising a device configured to be detected by a space detection system.

15. The multifunction writing instrument according to claim 14, wherein the device configured to be detected by a space detection system is a magnet ring.

16. A multifunction writing instrument comprising:

a body extending along an axial direction and receiving two or more movable writing elements, each of the movable writing elements comprising a writing tip and a chip, the movable writing elements being movable between a first position and a second position, and an electronic unit configured to detect which retractable writing element is in the first position, wherein the electronic unit comprises a wireless communication system configured to communicate with an outer device; and wherein each chip of each movable writing element is electrically connected to the wireless communication system when the movable writing element is in the first position and is electrically disconnected from the wireless communication system when the movable writing element is in the second position.

* * * * *